US006209797B1

(12) United States Patent
Jenney

(10) Patent No.: US 6,209,797 B1
(45) Date of Patent: Apr. 3, 2001

(54) WATER FOUNTAIN

(76) Inventor: Curtis Jenney, 1910 Springtime Ave., Clearwater, FL (US) 33755

( * ) Notice: Subject to any disclaimer, the term of this patent is extended or adjusted under 35 U.S.C. 154(b) by 0 days.

(21) Appl. No.: 09/616,008

(22) Filed: Jul. 13, 2000

(51) Int. Cl.[7] ..... B05B 17/08
(52) U.S. Cl. ..... 239/17; 239/20; 239/211
(58) Field of Search ..... 239/12, 16, 17, 239/20, 211, 289; D23/201, 285; 47/41.01, 41.14, 59

(56) References Cited

U.S. PATENT DOCUMENTS

D. 185,946 8/1959 Nign ..... D23/201
D. 205,392 7/1966 Mifsud ..... D23/201
3,409,223 11/1968 Gosh ..... 239/17
3,820,715 6/1974 Hamilton ..... 239/17

*Primary Examiner*—Lisa Ann Douglas

(57) ABSTRACT

A water fountain including a series of sculptured leaves with a wide rear and a narrow front. Each of the leaves includes a dished region in the center at a lower elevation, a periphery at a higher elevation and a plurality of flow points near the front at an intermediate elevation. The leaves are assembled in different planes over which the water flows creating a cascading effect. The water fountain also includes a series of pedestals on which a leaf is adjustably supported. Each pedestal consist of a top circular hoop, a bottom circular hoop, and a metal rod to connected the top hoop with the bottom hoop. Each metal rod is of a different height in order to allow each leaf to descend with respect to the next leaf to attain the cascade effect for decorative purposes.

5 Claims, 3 Drawing Sheets

FIG 3
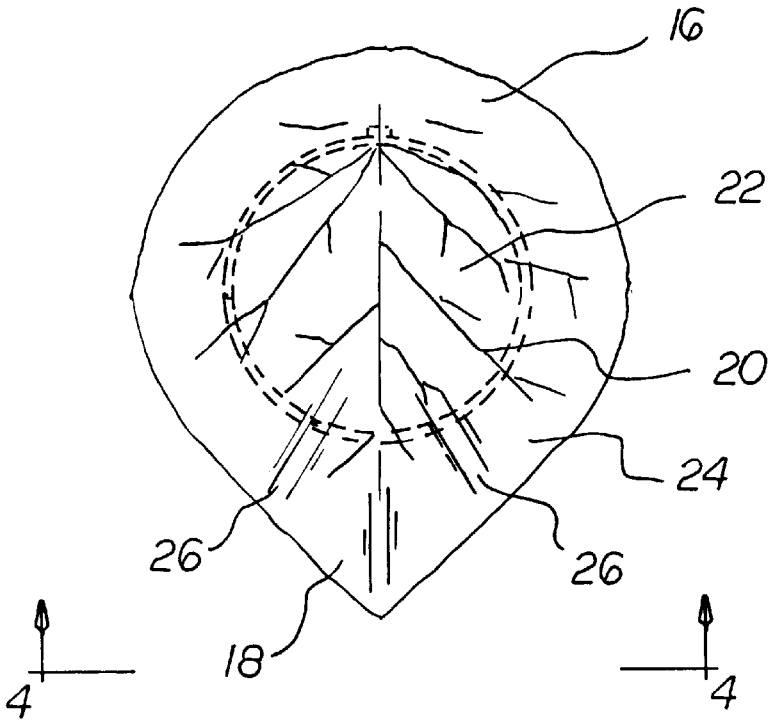
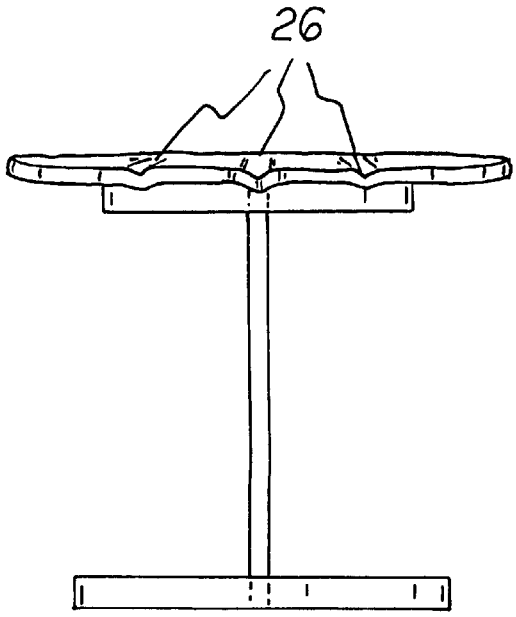
FIG 4

WATER FOUNTAIN

BACKGROUND OF THE INVENTION

1. Field of the Invention

The present invention relates to a water fountain and more particularly pertains to providing a cascade waterfall over a landscaped environment.

2. Description of the Prior Art

The use of water fountain of know designs and configurations is known in the prior art. More specifically, water fountain of know designs and configurations previously devised and utilized for the purpose of providing a cascade waterfall through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,008,646 to Benak discloses a color changing illuminated fountain. U.S. Pat. No. 5,326,032 to Quillin discloses a low splash steady state waterfall. U.S. Pat. No. Des. 185,946 to Nign discloses an ornamental design for fountain. Lastly, U.S. Pat. No. Des. 319,682 to Sharp discloses an ornamental design for a bowl for a fountain.

While these devices fulfill their respective, particular objectives and requirements, the aforementioned patents do not describe water fountain that allows for a cascade waterfall over a landscaped environment.

In this respect, the water fountain according to the present invention substantially departs from the conventional concepts and designs of the prior art, and in doing so provides an apparatus primarily developed for the purpose of providing a cascade waterfall over a landscaped environment.

Therefore, it can be appreciated that there exists a continuing need for a new and improved water fountain which can be used for providing a cascade waterfall over a landscaped environment. In this regard, the present invention substantially fulfills this need.

SUMMARY OF THE INVENTION

In view of the foregoing disadvantages inherent in the known types of water fountain of know designs and configurations now present in the prior art, the present invention provides an improved water fountain. As such, the general purpose of the present invention, which will be described subsequently in greater detail, is to provide a new and improved water fountain and method which has all the advantages of the prior art and none of the disadvantages.

To attain this, the present invention essentially comprises a new and improved water fountain for providing a cascade waterfall over a landscaped environment. The water fountain includes a series of three sculptured leaves in a generally heart-shaped form. The leaves contain a wide rear and a narrow front and lines forming nerves. Each of the leaves includes a dished region in the center at a lower elevation, a periphery at a higher elevation and three flow points near the front at an intermediate elevation. The leaves are assembled in different planes over which the water flows creating a cascading effect. The shapes and sizes of the leaves are adapted to direct a gentle flow of water from the flow points creating a cascade effect. The nerves of the leaves are placed in such a fashion to allow the water to flow gently only over the flow points of the leaves. The water fountain also includes a series of three metal pedestals upon each of which a leaf is adjustably supported. Each pedestal includes a top circular hoop of a first diameter, a bottom circular hoop of a second diameter and a metal rod to connected the top hoop with the bottom hoop. The first diameter is smaller than the second diameter. Each metal rod is of a different height in order to allow each leaf to descend with respect to the next leaf to attain the cascade effect for decorative purposes. The water flows from the top leaf to the intermediate leaf and to the bottom leaf. The leaves are molded in concrete or other waterproof durable materials, and painted in different natural tones with a finish that can be accomplished by a variety of paints and protective coats. The metal pedestals are made of iron and coated in a black polyurethane protective paint in order to prevent rust or decay. The water fountain also includes a pool of water to receive the flow from the bottom leaf. A submersible pump is included in the pool to cause the flow of water and a tube conveys the water from the pump to the top leaf in a recycling mode of operation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water fountain which has all of the advantages of the prior art water fountain of known designs and configurations and none of the disadvantages.

It is another object of the present invention to provide a new and improved water fountain which may be easily and efficiently manufactured and marketed.

It is further object of the present invention to provide a new and improved water fountain which is of durable and reliable constructions.

An even further object of the present invention is to provide a new and improved water fountain which is susceptible of a low cost of manufacture with regard to both materials and labor, and which accordingly is then susceptible of low prices of sale to the consuming public, thereby making such water fountain economically available to the buying public.

Even still another object of the present invention is to provide a water fountain for providing a cascade waterfall over a landscaped environment.

Lastly, it is an object of the present invention to provide a new and improved water fountain for providing a cascade waterfall over a landscaped environment. The water fountain includes a series of sculptured leaves with a wide rear and a narrow front. Each of the leaves includes a dished region in the center at a lower elevation, a periphery at a higher elevation and a plurality of flow points near the front at an intermediate elevation. The leaves are assembled in different planes over which the water flows creating a cascading effect. The water fountain also includes a series of pedestals on which a leaf is adjustably supported. Each pedestal consist of a top circular hoop, a bottom circular hoop, and a metal rod to connected the top hoop with the bottom hoop. Each metal rod is of a different height in order to allow each leaf to descend with respect to the next leaf to attain the cascade effect for decorative purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top elevational view of one of the leaves and its associated pedestal.

FIG. 4 is a front elevational view taken alone line 4—4 of FIG. 3.

The same reference numerals refer to the same parts throughout the various Figures.

DESCRIPTION OF THE PREFERRED EMBODIMENT

Figure 1:
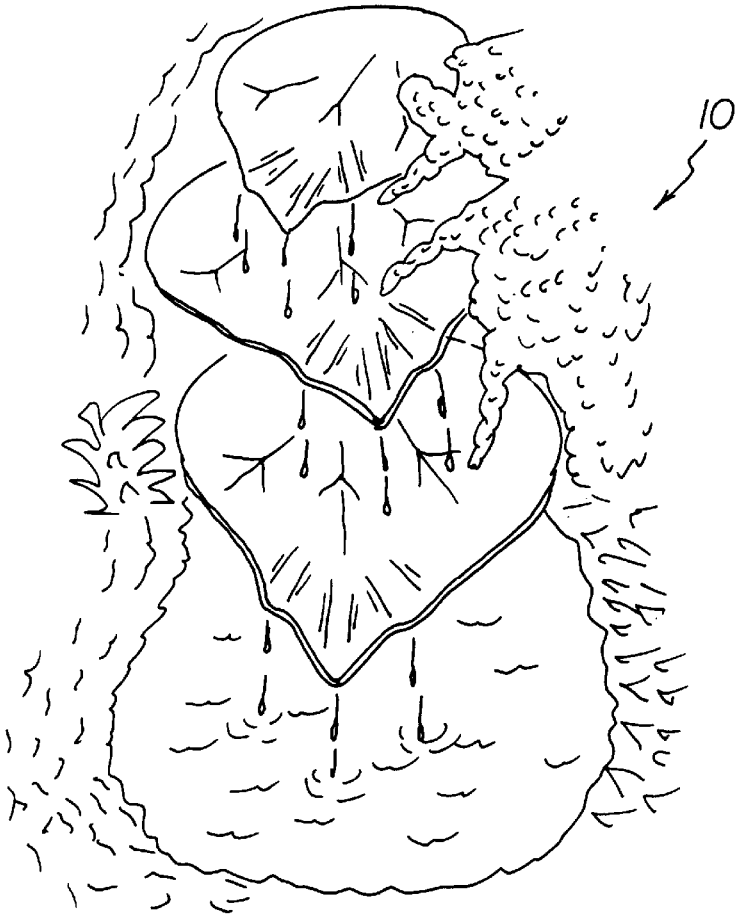
FIG. 1 is a perspective illustration of the new and improved water fountain constructed in accordance with the principles of the present invention.
Figure 2:
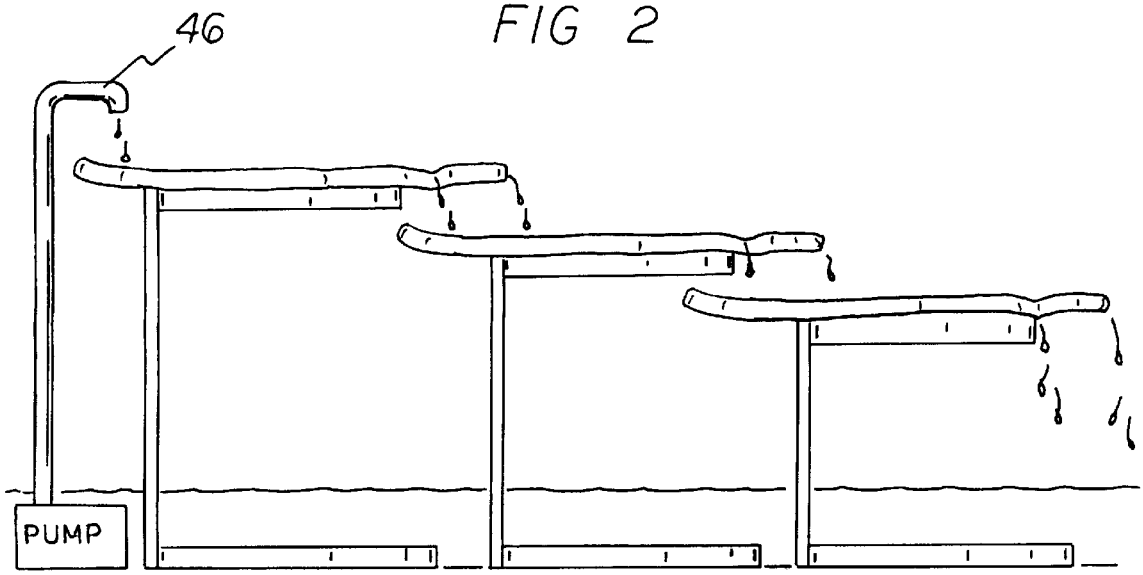
FIG. 2 is a side elevational view of the leaves and pedestals shown in FIG. 1.
Figure 5:
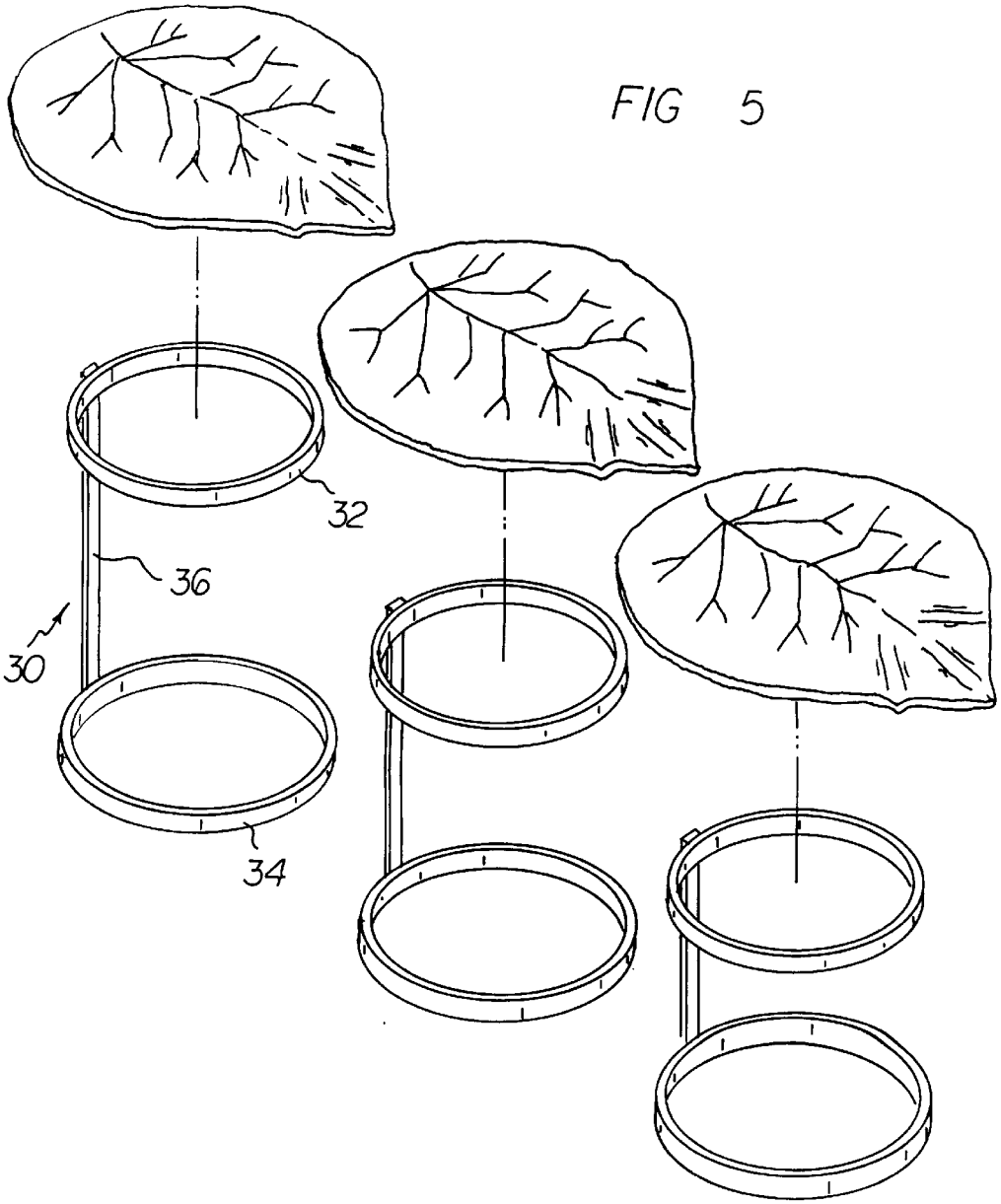
FIG. 5 is a exploded perspective view of the leaves and pedestals as shown in the prior Figures.

With reference now to the drawings, and in particular to FIG. 1 thereof, the preferred embodiment of the new and improved water fountain embodying the principles and concepts of the present invention and generally designated by the reference numeral 10 will be described.

The present invention, the water fountain 10 is comprised of a plurality of components. Such components in their broadest context include a series of sculptured leaves and a series of pedestals. Such components are individually configured and correlated with respect to each other so as to attain the desired objective.

A water fountain 10 is first provided which results in a cascade waterfall over a landscaped environment. The water fountain includes a series of three sculptured leaves 14 in a generally heart-shaped form. The leaves contain a wide rear 16 and a narrow front 18 and lines forming nerves 20. Each of the leaves includes a dished region 22 in the center at a lower elevations a periphery 24 at a higher elevation and three flow points 26 near the front at an intermediate elevation. The leaves are assembled in different planes over which the water flows creating a cascading effect. The shapes and sizes of the leaves are adapted to direct a gentle flow of water from the flow points creating a cascade effect. The nerves of the leaves are placed in such a fashion to allow the water to flow gently only over the flow points of the leaves.

The water fountain also includes a series of three metal pedestals 30 upon each of which a leaf is adjustably supported. Each pedestal includes a top circular hoop 32 of a first diameter, a bottom circular hoop 34 of a second diameter and a metal rod 36 to connect the top hoop with the bottom hoop. The first diameter is smaller than the second diameter. Each metal rod is of a different height in order to allow each leaf to descend with respect to the next leaf to attain the cascade effect for decorative purposes. The water flows from the top leaf to the intermediate leaf and to the bottom leaf. The leaves are molded in concrete or other waterproof durable materials. They may then be painted in different natural tones with a finish that can be accomplished by a variety of paints and protective coats.

The metal pedestals are made of iron. They may be coated in a black polyurethane protective paint in order to prevent rust or decay.

The water fountain of the present invention also includes a pool of water 40. Such pool functions to receive the flow from the bottom leaf.

A submersible pump is included in the pool to cause the flow of water. Lastly, a tube 46 functions to convey the water from the pump to the top leaf in a recycling mode of operation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A water fountain for providing a cascade waterfall over a landscaped environment, comprising, in combination:

a series of three sculptured leaves in a generally heart-shaped form with a wide rear and a narrow front and with lines forming nerves, each of the leaves having a dished region in the center at a lower elevation, a periphery at a higher elevation and three flow points near the front at an intermediate elevation, the leaves being assembled in different planes over which water flows creating a cascading effect, the shapes and sizes of the leaves adapted to direct a gentle flow of water from the flow points creating a cascade, the nerves of the leaves being placed in such a fashion to allow the water to flow gently only over the flow points of the leaves;

a series of three metal pedestals upon each of which a leaf is adjustably supported, each pedestal consisting of a top circular hoop of a first diameter, a bottom circular hoop of a second diameter, the first diameter being smaller than the second diameter, and a metal rod to connect the top hoop with the bottom hoop, each metal rod is of a different height in order to allow each leaf to descend with respect to the next leaf to attain the cascade effect for decorative purposes with water flowing from a top leaf to an intermediate leaf to a bottom leaf;

the leaves being molded in concrete or other waterproof durable materials, the leaves being painted in different natural tones with a finish that can be accomplished by a variety of paints and protective coats;

the metal pedestals being made of iron and coated in a black polyurethane protective paint in order to prevent rust or decay;

a pool of water to receive the flow from the bottom leaf;

a submersible pump in the pool to cause the flow of water; and a tube to convey water from the pump to the top leaf in a recycling mode of operation.

2. A water fountain for providing a cascade waterfall over a landscaped environment, comprising:

a series of sculptured leaves with a wide rear and a narrow front, each of the leaves having a dished region in the center at a lower elevation, a periphery at a higher elevation and, a plurality of flow points near the front at an intermediate elevation, the leaves being assembled in different planes over which water flows creating a cascading effect;

a series of pedestals on which a leaf is adjustably supported, each pedestal consists of a top circular hoop, a bottom circular hoop, and a metal rod to connect the top hoop with the bottom hoop, each metal rod is of a different height in order to allow each leaf to descend with respect to the next leaf to attain the cascade effect for decorative purposes.

3. The water fountain as set forth in claim 2 and further comprising a pool of water to receive the flow from a bottom leaf, a submersible pump in the pool, and a tube to convey water from the pump to a top leaf.

4. The water fountain as set forth in claim 2 wherein the leaves being molded in concrete or other waterproof durable materials and painted in different natural tones with a finish that can be accomplished by a variety of paints and protective coats.

5. The water fountain as set forth in claim 2 wherein the metal pedestals being made of iron and coated in a black polyurethane protective paint in order to prevent rust or decay.

* * * * *